US005381386A

United States Patent [19]

Lum et al.

[11] Patent Number: 5,381,386

[45] Date of Patent: Jan. 10, 1995

[54] MEMBRANE HYDROPHONE

[75] Inventors: Paul Lum; Michael Greenstein, both of Los Altos, Calif.

[73] Assignee: Hewlett-Packard Company, Palo Alto, Calif.

[21] Appl. No.: 64,611

[22] Filed: May 19, 1993

[51] Int. Cl.[6] ..... H04R 17/00

[52] U.S. Cl. ..... 367/163; 310/337; 310/800

[58] Field of Search ..... 310/324, 800, 334, 337; 367/163

[56] References Cited

U.S. PATENT DOCUMENTS

| | | | |
|---|---|---|---|
| 4,433,400 | 2/1984 | DeReggi et al. | 367/163 |
| 4,653,036 | 3/1987 | Harris et al. | 367/170 |
| 4,734,611 | 3/1988 | Granz | 310/324 |
| 4,789,971 | 12/1988 | Powers et al. | 367/152 |
| 4,906,886 | 3/1990 | Breimesser et al. | 310/334 |
| 5,035,247 | 7/1991 | Heimann | 128/715 |
| 5,160,870 | 11/1992 | Carson et al. | 310/324 |
| 5,189,777 | 3/1993 | Guckel et al. | 29/424 |

OTHER PUBLICATIONS

Howe et al., "Silicon micromechanics:sensors & Actuctors on a clip," IEEE Spectrum, Aug. 1990, pp. 29–35.

Brendel, Klaus et al., "Hydrophone Measurements," Ch. 5, Part A, *Ultrasonic Exposimetry,* Ed. Marvin C. Ziskin et al., CRC Press, pp. 116–125.

DeReggi, A. S. et al., "Piezoelectric polymer probe for ultrasonic applications," *J. Acoust. Soc. Am.,* vol. 69, No. 3, Mar. 1981, pp. 853–859.

Preston, R. C. et al., "PVDF membrane hydrophone performance properties and their relevance to the measurement of the acoustic output of medical ultrasonic equipment," *J. Phys. E: Sci. Instrum.,* vol. 16, 1983, pp. 786–796.

*Primary Examiner*—Ian J. Lobo

[57] ABSTRACT

A method of fabricating a membrane acoustic device includes utilizing integrated circuit fabrication techniques to form a support structure for a piezoelectric membrane, to pattern interconnect schemes on the membrane and on a semiconductor substrate, and to form electronic components for amplifying and driving signals generated at one or more piezoelectrically strong active areas. The support structure is a lithographically patterned metal layer on the semiconductor substrate. A matching metallization on the piezoelectric membrane is conductively bonded to the metal support structure of the semiconductor substrate. An acoustic cavity area is etched through the semiconductor substrate to the back surface of the membrane. An extremely small membrane hydrophone can thereby be fabricated for operation at frequencies above 50 MHz.

13 Claims, 6 Drawing Sheets

MEMBRANE HYDROPHONE

TECHNICAL FIELD

The present invention relates generally to acoustic devices and more particularly to membrane hydrophones and the fabrication of membrane hydrophones.

BACKGROUND ART

Ultrasonic devices may be used in a wide variety of applications, such as acoustic pressure sensors for ultrasonic field characterization. A hydrophone is a type of ultrasonic device that has been employed as an acoustic pressure sensor for calibrating an ultrasonic transducer used in medical diagnosis and therapy. Calibration of the ultrasonic transducer can be achieved by directing waves from the transducer to the hydrophone. The hydrophone is operated to provide a quantitative assessment of the characteristics of the ultrasonic field that is created by the transducer in a liquid, such as water.

Performance properties such as sensitivity, frequency response, acoustic transparency and immunity to rf interference must be considered in the design of a hydrophone for ultrasonic field characterization. One type of hydrophone design is a needle-like device described in U.S. Pat. No. 4,789,971 to Powers. et al. Despite the small size of the needle-like hydrophone, this type unavoidably changes the ultrasonic field that is to be characterized. Perturbations of the field are generated as a result of the geometry of the hydrophone and the substantial difference in acoustic impedance between the hydrophone and the liquid in which the hydrophone is immersed.

A membrane hydrophone is a type of device that is generally more acoustically transparent than the needle-like devices. Membrane hydrophones are described in U.S. Pat. Nos. 4,433,400 to DeReggi et al. and 4,653,036 to Harris et al. Such hydrophones typically include a thin polyvinylidene fluoride (PVDF) film that is held taut by a rigid hoop. PVDF membranes are employed because the acoustic impedance of PVDF is relatively close to that of water. Impedance matching reduces the reflections generated by the hydrophone. Moreover, the diameter of the hoop is typically several times as large as the diameter of the acoustic beams that are to be encountered, so that the hoop is less likely to generate perturbations.

The manufacture of a membrane hydrophone is described in the above-identified patent to DeReggi et al. The PVDF membrane may be a single sheet or may be a bilaminate member. The membrane is clamped between inner and outer hoop rings that may be made of brass. The center of the membrane is poled to provide an active sensing area. The active area is strongly piezoelectric and typically is smaller than the wavelength of the highest frequency to be encountered. For example, the active area may have a diameter of approximately 0.5 mm. Electrodes are formed on the opposed sides of the active area and leads extend from the electrodes for the conduction of an electrical signal from the active area. The electrodes and leads may be deposited on the PVDF by vacuum evaporation through a metallic mask. The electrodes and leads may also be formed photolithographically.

DeReggi et al. also describes using a silicon rubber to fix a preamplifier to the PVDF membrane. The preamplifier is used to achieve impedance matching for electrical connection to a coaxial transmission line that is connected to the hoop. A typical membrane additionally has a metallized ground plane coating on at least one exterior surface in order to achieve rf interference shielding.

It is an object of the present invention to provide a membrane acoustic device and a method of fabricating such a device utilizing techniques which integrate the various components necessary to achieve a high sensitivity over a wide range of frequencies.

SUMMARY OF THE INVENTION

The above object has been met by utilizing integrated circuit fabrication techniques to form a membrane support structure, one or more interconnect schemes, and any electronics desired for operating a membrane acoustic device, such as a membrane hydrophone. In a preferred embodiment, the support structure and the electronics are fabricated on a semiconductor substrate. A standard-sized silicon wafer may be employed as the substrate.

The silicon wafer is covered on both a front and back side by a layer of oxide. A thin film of silicon dioxide ($SiO_2$) satisfies the requirements of this oxide layer. The front side is then covered with a low stress dielectric film, such as silicon nitride or polyimide. The dielectric covering of the silicon wafer serves as an etch stop in subsequent steps.

A conductive material is deposited and patterned on the front side. Standard photolithographic processing is employed to form electrical interconnects and form a raised support structure that defines the area which is to be spanned by a piezoelectric membrane. Alignment marks may also be formed in this step. Optionally, a passivation layer covers the patterned conductive material to provide protection in subsequent steps. If the passivation layer is included, regions of the patterned conductive layer that are to be connected to the membrane should be left uncovered.

The piezoelectric membrane should have an acoustic impedance that is close to the acoustic impedance of the liquid into which the device is to be immersed, so that the membrane is substantially transparent to acoustic waves to be encountered. An acceptable material is PVDF, but the copolymer P(VDF-TrFE) is preferred because of its flexibility with regard to the poling process that is conventionally employed in defining a piezoelectrically strong active area. In the preferred embodiment, the active area is at the center of the piezoelectric membrane. The membrane may be of the single-sheet type, but may also be bilaminate.

The piezoelectric membrane is temporarily mounted to a ring structure. The temporary ring structure holds the membrane in a condition that facilitates the patterning of metallic layers on major surfaces of the membrane. A ground plane layer may be formed on the front surface of the membrane, while the back surface includes a metallic layer that is patterned to form an electrode, an interconnect scheme, and a structure to mate with the support structure of the silicon wafer.

The matching structures of the silicon wafer and the piezoelectric membrane are then aligned and fixed to one another. A conductive epoxy or a solder paste may be employed to bond the piezoelectric membrane to the wafer, but the use of other materials is possible. Because the support structure attaches the membrane to the wafer, the temporary ring structure may be removed and the membrane may be trimmed.

A cavity is formed through the silicon wafer to the back surface of the piezoelectric membrane. A wax covering protects the front sides of the membrane and wafer. Integrated circuit fabrication techniques are used to form the cavity. A first etching removes silicon, but is etch-stopped by the $SiO_2$ on the front side of the wafer. A second etch removes the $SiO_2$ layer. The wax coating must also be removed.

In addition to the interconnects and the support structure, active and/or passive electronic components may be fabricated on the semiconductor wafer by integrated circuit chip fabrication techniques. For example, a preamplifier can be fabricated to achieve an impedance match with a transmission line connected to the membrane hydrophone. BiCMOS or bipolar processing is possible. In a final step, the membrane hydrophone is joined to a holder assembly for electrically interfacing the membrane/silicon wafer to a coaxial connector.

An advantage of the present invention is that extremely small membrane hydrophones may be manufactured. The silicon wafer provides a rigid non-flexing support structure both during and following processing. The support structure, the electronics and the interconnects are all formed by the semiconductor processing approach.

BEST MODE FOR CARRYING OUT THE INVENTION

Figure 1:
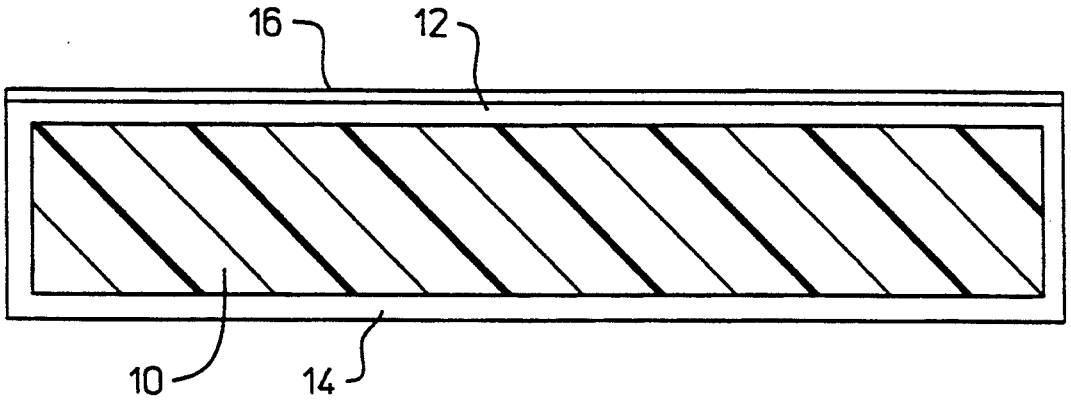
FIG. 1 is a side sectional view of a semiconductor wafer having dielectric layers formed in accordance with the first step of the present invention.

With reference to FIG. 1, a substrate 10 is shown as having a layer of oxide 12 on a front side and a layer of oxide 14 covering the back side of the substrate 10. In a preferred embodiment, the substrate is a semiconductor wafer that permits the use of integrated circuit chip fabrication techniques in order to form a membrane hydrophone. For example, the substrate may be a silicon wafer having a <100> or <110> orientation. The silicon wafer may be a p-type or n-type wafer. A standard four or six inch wafer is acceptable.

The oxide 12 and 14 may be a conventional wet oxide or a field oxide film. In the preferred embodiment, the oxide is $SiO_2$ having a thickness of approximately 17 μm. A minimum thickness is 5000 Å.

A low stress silicon nitride layer 16 is formed on the front side of the silicon wafer 10. A low pressure chemical vapor deposition process may be used to deposit the layer 16 to a thickness of approximately 1 μm. The dielectric layers 12 and 16 on the front side of the silicon wafer will be used as an etch stop in subsequent processing steps. Portions of the layers will then be removed.

As a substitute for the silicon nitride layer 16, a spin-on polyimide may be formed. Such a layer should be thicker than the silicon nitride. The polyimide layer functions well as a dielectric on which an interconnect scheme can be photolithographically patterned.

Figure 2:
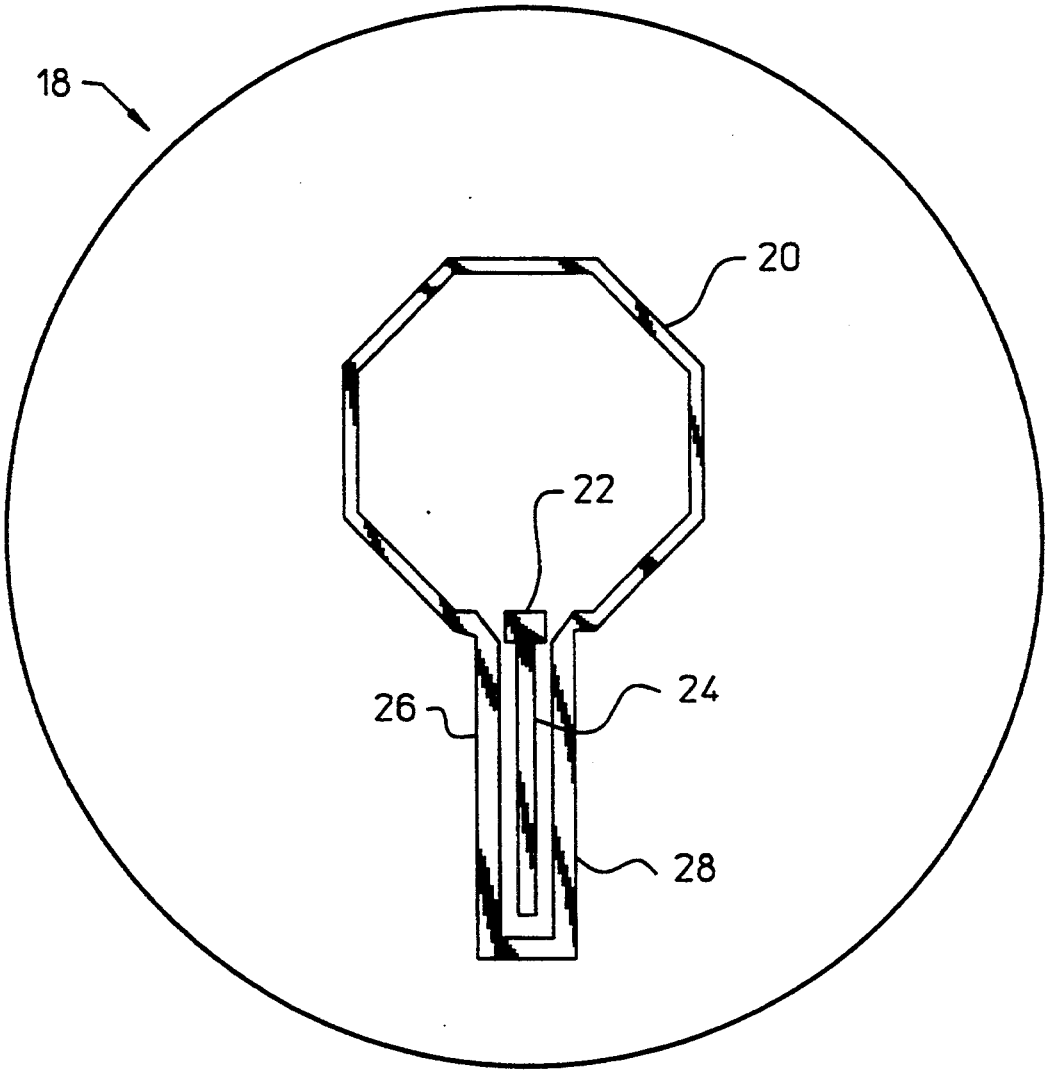
FIG. 2 is a top view of a mask for patterning a metal layer on the wafer of FIG. 1.

A non-oxidizing, noble metal is deposited and patterned on the front side thickness of the silicon wafer 10. Standard photolithographic techniques can then be used to pattern the metal layer. FIG. 2 shows a photolithographic mask 18 for exposing a photoresist on the metal layer.

An octagonal region 20 on the mask 18 defines an image of a support structure which is to be attached to a piezoelectric membrane. The shape of the region 20 is not critical, but preferably is symmetrical so as to provide generally uniform support about the periphery of the piezoelectric membrane. Conventional membrane hydrophones are circular, but arcuate shapes are difficult to fabricate photolithographically.

In addition to the octagonal region 20 that defines the support structure, the mask 18 includes the geometry of an interconnect pad 22 and an interconnect trace 24. The pad to be formed will connect to a matching pad on the piezoelectric membrane for conducting a signal from an active area of the membrane. On the opposed sides of the trace are regions 26 and 28 to define a ground structure for shielding the trace from rf interference. That is, a coaxial interconnect scheme is designed.

Figure 3:
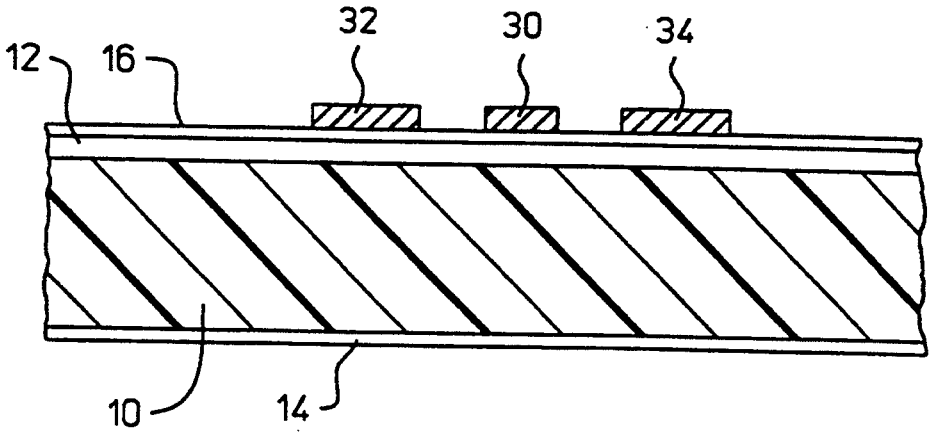
FIG. 3 is a partial side view of a patterned metal layer on the wafer of FIG. 1.

Referring now to FIG. 3, a silicon wafer 10 is shown as including the patterned metallization to form the coaxial interconnection scheme. An interconnect trace 30 is positioned between two ground lines 32 and 34. The dimensions of the trace 30 are determined by the trace image 24 on the mask 18 of FIG. 2, while the geometries of the ground lines 32 and 34 are determined by regions 26 and 28 on the mask 18.

An acceptable metallization for the trace 30 and the ground lines 32 and 34 of FIG. 3 is a CrAu layer in which a lower chromium film has a thickness of 200–300 Å and an upper film of gold has a thickness in the range of 3000 to 4000 Å. While not shown, the silicon wafer 10 will include the support structure defined by the octagonal region 20 of the mask 18 of FIG. 2. Moreover, while it is not critical, gross alignment marks may be fabricated on the back side of the silicon wafer 10 for achieving proper alignment in subsequent steps.

Figure 4:
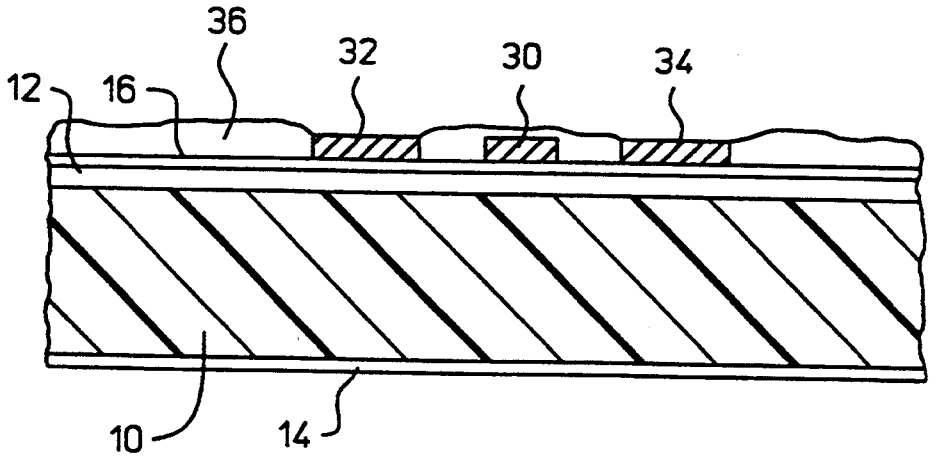
FIG. 4 is a side view of the wafer of FIG. 3 having a protective coating on a front side thereof.

Preferably, the front side of the silicon wafer 10 is then coated with a passivation layer 36 shown in FIG. 4. The passivation layer is an optional layer that is used to protect the regions of the patterned metallization that are not to be bonded directly to the piezoelectric membrane. Therefore, the octagonal support structure is left exposed. The passivation layer is shown as completely covering the interconnect trace 30. However, the interconnect pad, not shown, at the end of the trace must be left uncovered in order to allow contact with a matching pad on the piezoelectric membrane. In the preferred embodiment, the piezoelectric membrane includes a patterned metallization that matches the octagonal region 20 and the linear regions 26 and 28 of the mask 18 of FIG. 2. Therefore, the ground lines 32 and 34 of FIG. 4 remain uncovered by the passivation layer 36. Following the formation of the passivation layer, the support structure may be made more robust by electroplating a conductive material onto metallization left exposed by the passivation layer. For example, a gold layer having a thickness of approximately 1 μm may be added to the exposed metallization. The selection of the material for forming the passivation layer is not critical. However, the material should have an adequate step coverage and should have a reflow temperature less than the hard bake temperature of the dielectric layer 16.

Figure 5:
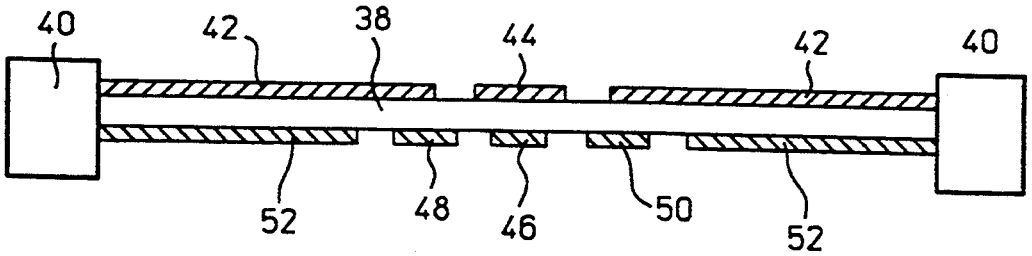
FIG. 5 is a side sectional view a piezoelectric membrane having patterned metal layers in accordance with the present invention.

The silicon wafer 10 may then be joined to the piezoelectric membrane. Referring now to FIG. 5, the membrane 38 is shown as being mounted to a temporary ring structure 40. The ring structure supports the piezoelectric membrane in a condition that facilitates photolithographic processing at the opposed sides of the membrane. Fabrication is more easily carried out for a single-sheet membrane, but bilaminate membranes can also be employed with the present invention.

The membrane 38 has a thickness of 25 μm. In the preferred embodiment, the membrane material is P(VDF-TrFE). A ground plane 42 is formed on the front surface of the membrane. The front surface also includes a ground electrode 44. At the back surface of the membrane is an interconnect pad 46 that is electrically connected to a hot electrode, not shown. On the opposed sides of the pad 46 are ground members 48 and 50. The ground members are configured to match structure on the silicon wafer described above. Also shown on the back surface of the membrane 38 is a grounded film 52.

The patterned metal films on the opposed surfaces of the membrane 38 can be fabricated using conventional integrated circuit manufacturing techniques. For example, a spin-on photoresist can be applied to the opposed surfaces of the membrane. The membrane should be cleaned and prepared in order to optimize adhesion of the resist. The resist is then exposed to define the desired pattern.

optionally, the exposed photoresist can be subjected to a chlorobenzene soak to improve liftoff definition. The photoresist is developed and a metal film is deposited. The metal film may be a CrAu film having a thickness in the range of 1000 Å to 4 μm. A dissolving agent is then applied to remove undeveloped photoresist and the film that is atop the undeveloped photoresist. This liftoff operation leaves the exposed photoresist and the desired pattern of CrAu film.

The above-described method of patterning the CrAu film may optionally be used to form background focusing and alignment marks. Such marks are particularly useful for obtaining extremely fine-line structures.

Figure 6:
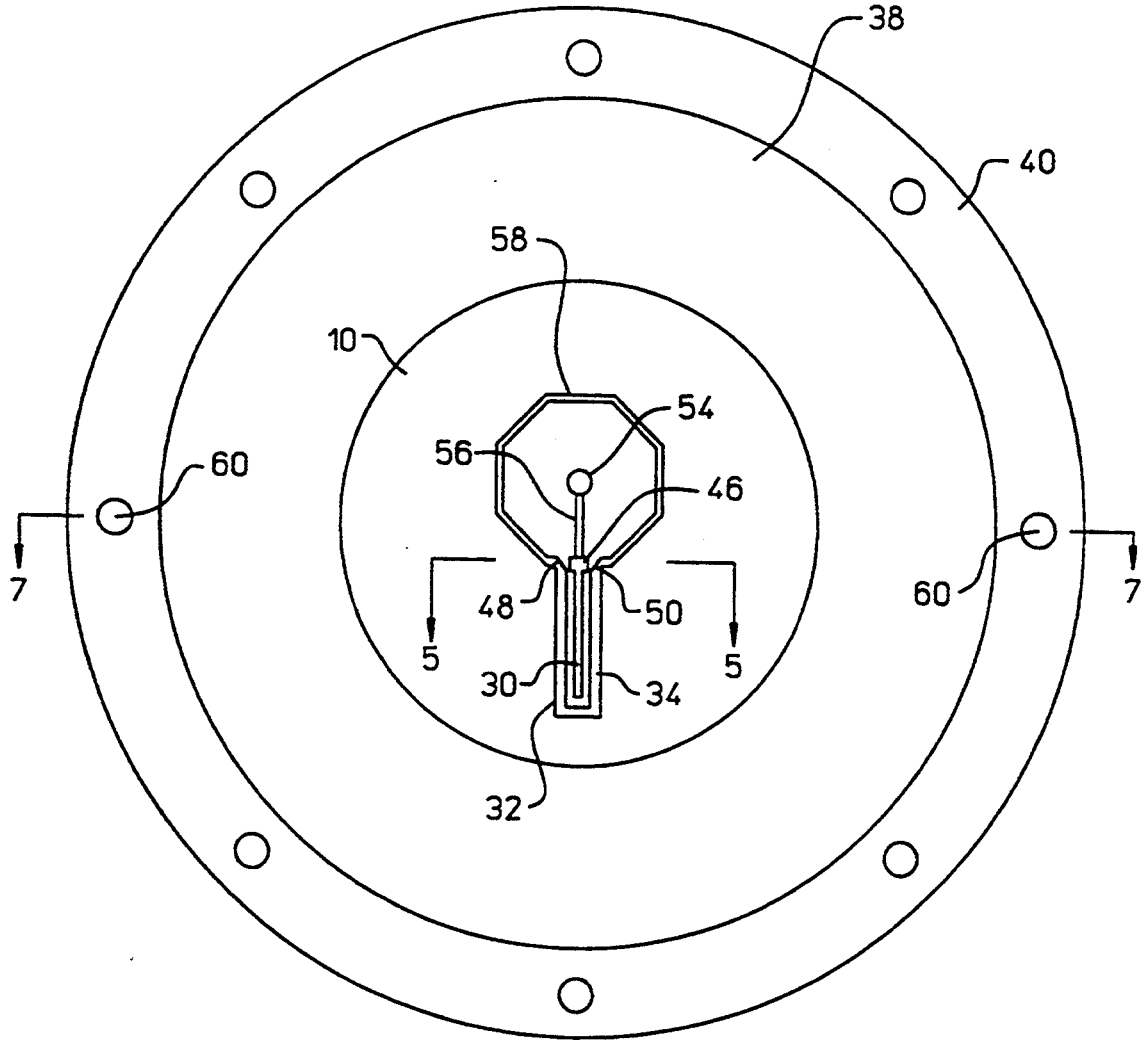
FIG. 6 is a top view of the membrane of FIG. 5 seated upon the wafer of FIG. 4.

In FIG. 6 the attachment of the piezoelectric membrane 38 to the silicon wafer 10 is shown schematically. For the purpose of illustration, the membrane is transparent. As noted above, the membrane includes a hot electrode 54 at a central region. The combination of an applied field and an elevated temperature for a set period of time causes poling of the region associated with the hot electrode 54, thereby providing a strongly piezoelectric active area. Poling parameters are well known in the art. The hot electrode 54 and an interconnect trace 56 are on the back surface of the piezoelectric membrane 38. The interconnect trace 56 leads to the pad 46 of FIG. 5. This pad 46 is aligned with a wafer pad at the end of the interconnect trace 30 shown on the silicon wafer 10 in FIGS. 3 and 6.

Figure 7:
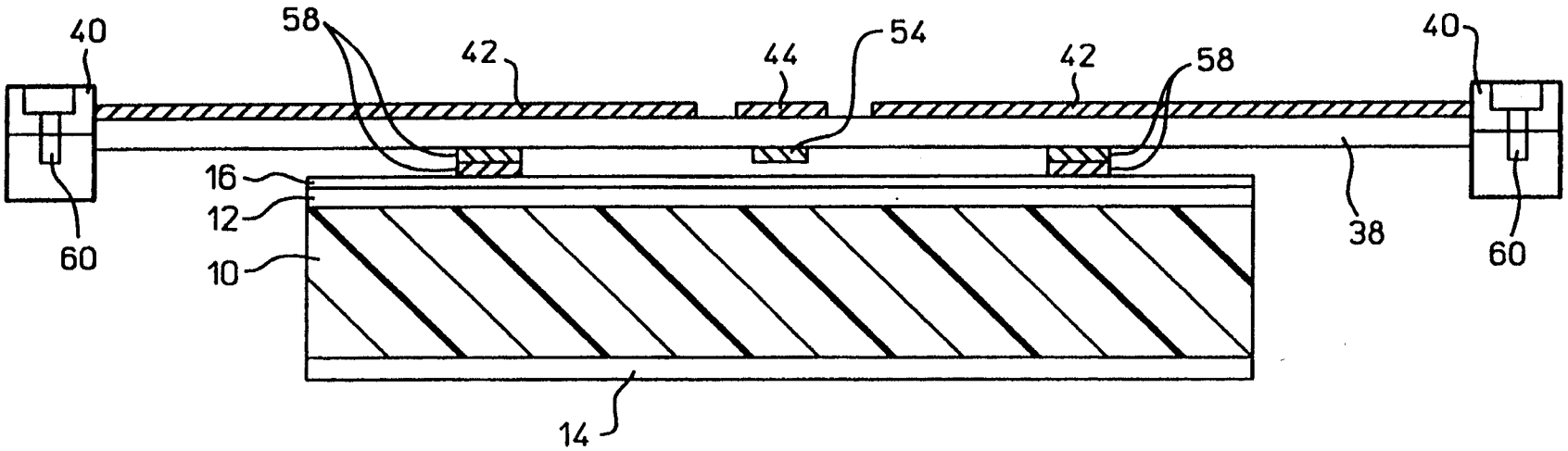
FIG. 7 is a side sectional view of the structure of FIG. 6, taken along lines 7—7.

In the preferred embodiment, the octagonal support structure 58 is formed on both the membrane and the silicon wafer, thereby providing matched patterned metal layers for bonding the membrane to the wafer. This is best seen in FIG. 7. Alignment marks, not shown, may be used to facilitate proper positioning of the membrane 38 relative to the silicon wafer 10. The two portions of the octagonal support structure 58, as well as any interconnect lines and pads that are to be joined, may be bonded by a conductive epoxy or solder paste. The means of connection is not critical, but the piezoelectric membrane 38 must be maintained in a taut condition.

Portions of the piezoelectric membrane 38 that extend beyond the octagonal support structure 58 may then be removed. Excess piezoelectric material is simply trimmed. The temporary ring structure 40 is then free for use in patterning another piezoelectric membrane. Assembly screws are tightened and loosened within internally-threaded bores 60 that secure the components of the reusable ring structure.

Figure 8:
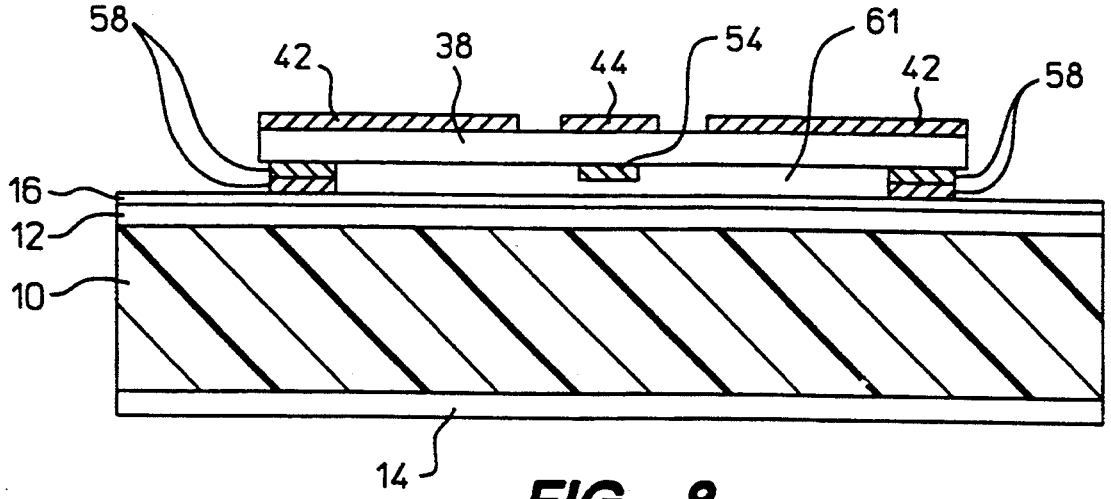
FIGS. 8–11 are side sectional views of processing steps for forming a membrane hydrophone in accordance with the present invention.

Referring now to FIG. 8, a membrane hydrophone is shown as having an enclosed plenum 61 between the piezoelectric membrane 38 and the silicon wafer 10. In the preferred embodiment, a working acoustic cavity area is formed by etching an opening through the silicon to the back surface of the membrane. Optionally, the structure of FIG. 8 may be tested before the etching process. A network analyzer may be employed to ensure proper bonding of the interconnect schemes of the membrane and the silicon wafer. Test pads may be formed on the silicon wafer for removal following testing.

Figure 9:
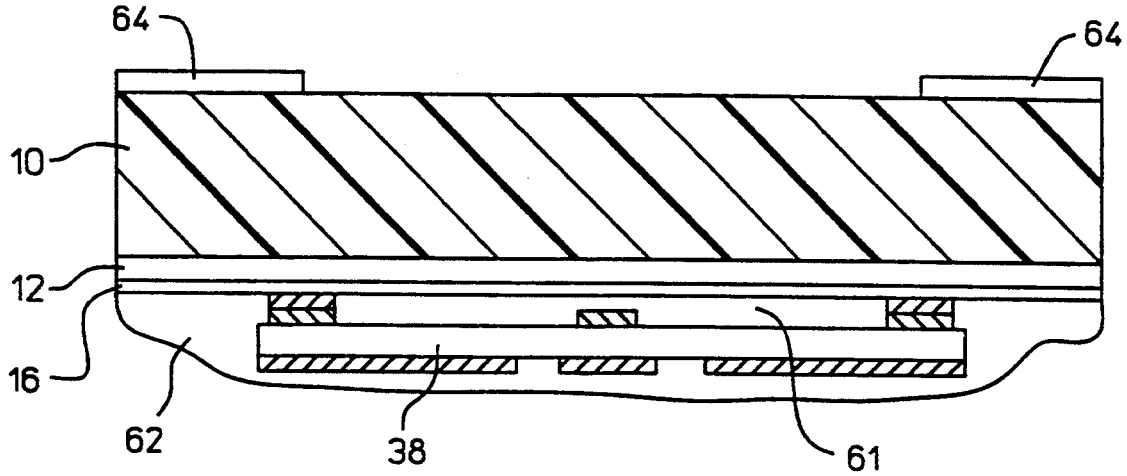

For applications in which a working acoustic cavity area is to be formed through the silicon wafer 10, a protective wax layer should be used to cover the piezoelectric membrane and its related structure. FIG. 9 shows an inverted hydrophone having a wax coating 62. A patterned photoresist 64 at the back side of the wafer 10 defines the area that is to undergo etching. Some undercutting of the photoresist will occur. Therefore, the area of the wafer exposed by the photoresist process should be less than the area designed for etching.

As previously noted, the dielectric layers 12 and 16 on the front side of the silicon wafer 10 act as an etch stop. The etchant selected in removing the material from the silicon wafer should be one having a high selectivity of silicon to $SiO_2$. Two acceptable etchants are $Hf:HNO_3=CH_3COOH$ and hot KOH with a propanol cap. Characteristic etch rates are as follows:

TABLE 1

| Contents | | Temp. | Etch Rate(s) Si etch | Etch Rate(s) $SiO_2$ etch | Etch Ratio |
|---|---|---|---|---|---|
| HF | 8% | @ 22° C. | All growths | 3 μ/hr | 200:1 |
| $HNO_3$ | 66% | | <100>, | | |
| | | | <110>, | | |
| $CH_3COOH$ | 26% | | <111> | | |
| | | | 600 μ/hr | | |
| KOH | 44% | @ 80° C. | 20 μ/hr | .05 μ/hr | 400:1 |
| $H_2O$ | 49% | | | | |
| Propanol | 2% | | | | |

Figure 10:
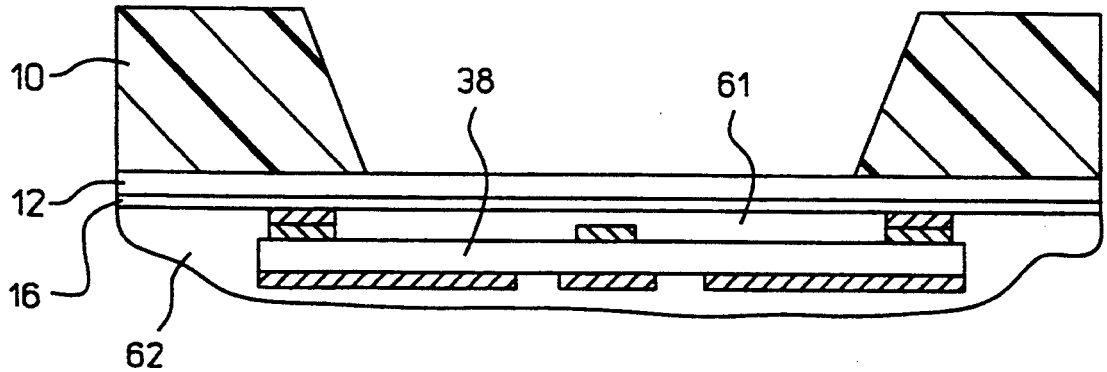
Figure 11:
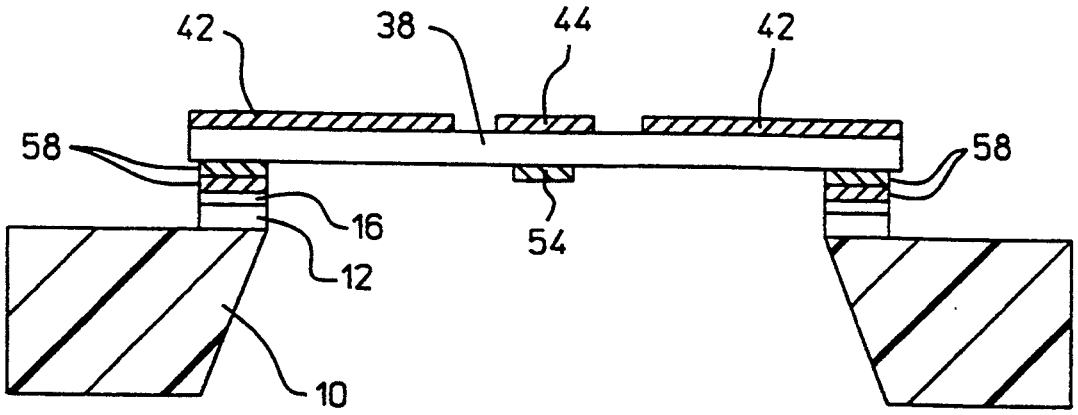

FIG. 10 illustrates the inverted membrane hydrophone after the silicon has been etched and the photoresist has been removed from the back side of the silicon wafer 10. Portions of the $SiO_2$ layer 12 and the layer 16 are then removed using a quick, buffered dip. The removal of the dielectric material at the back surface of the piezoelectric membrane 38 is required. Optionally, the portions of these layers that are radially outward of the membrane may be removed. The resulting membrane hydrophone is shown in FIG. 11.

If active and passive integrated circuitry is desired on one or both sides of the semiconductor wafer 10, the circuitry will have been fabricated and tested prior to the above-described process steps. For example, a preamplifier may be formed to achieve amplification of the signal generated at the active area of the piezoelectric membrane 38, as well as to provide impedance matching with a transmission line that is connected to the membrane hydrophone. BiCMOS or bipolar processing may be used. A gold interconnect scheme may be used as part of the final steps of the process. Thus, upon exiting bipolar processing, the silicon wafer can be DC/AC parametric tested to meet particular amplifier specifications.

Figure 12:
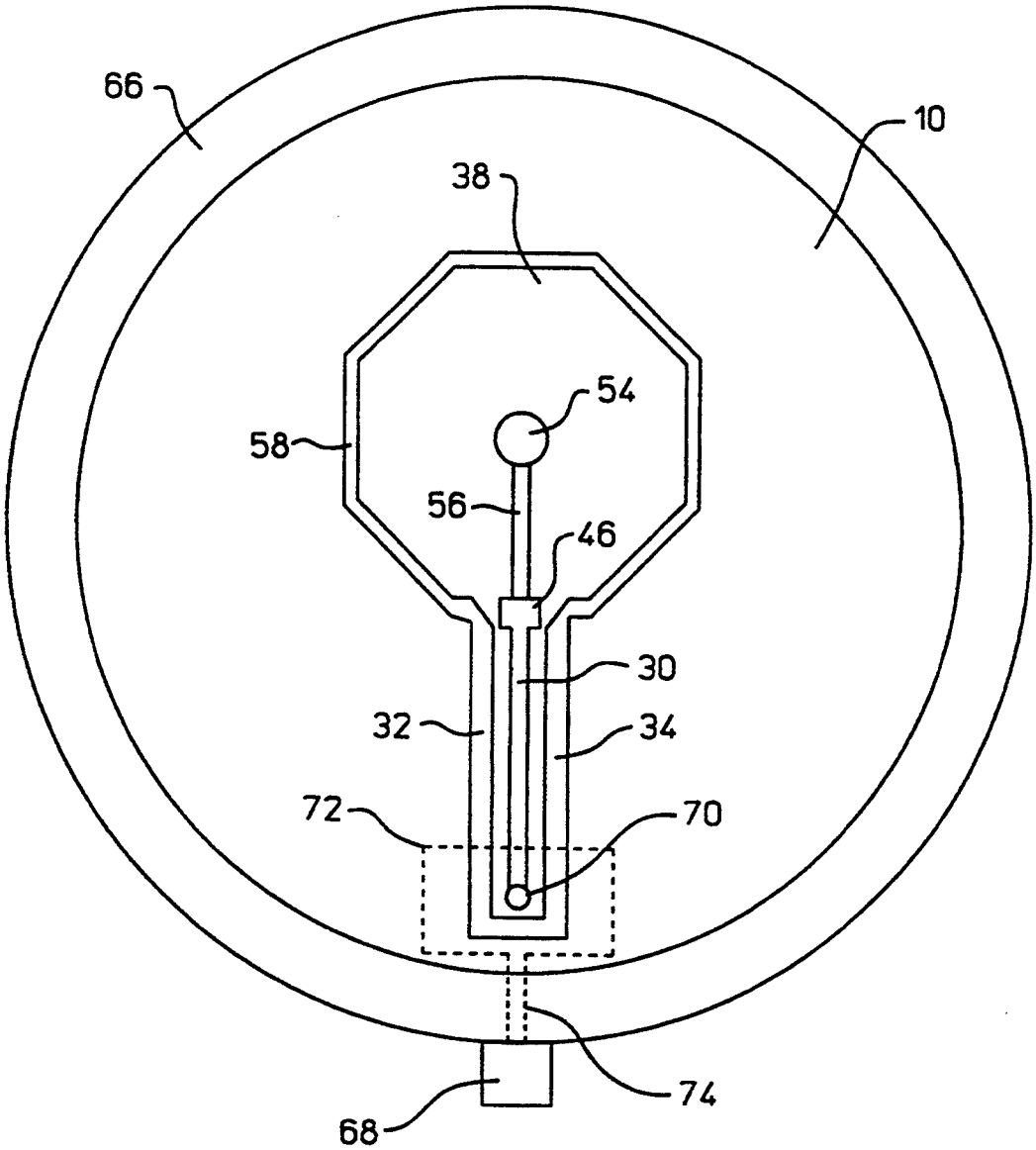
FIG. 12 is a top view of a representation of the membrane hydrophone of FIG. 11.

The final step of the preferred embodiment is to attach the silicon wafer 10 to a phenolic or molded plastic holder assembly 66 shown in FIG. 12. The holder assembly is used for electrically interfacing the membrane 38/wafer device to a coaxial connector 68. For the purpose of explanation, the piezoelectric membrane 38 is shown as being transparent, so that the hot electrode 54, the interconnect traces 56 and 30, and the pad 46 are visible. Also shown is a plated via 70 that extends through the silicon wafer 10 for electrical connection to a back side preamplifier 72. A back side interconnect trace 74 conducts the amplified signal to the coaxial connector 68.

The membrane hydrophone has been described and illustrated as having a single active region. Alternatively, a two-dimensional array of poled active regions may be formed, with a hot electrode operatively associated with each active area in the array. On-wafer electronics can be fabricated to provide preamplification of the separate signals. A multiplexer could also be formed in order to select among the signals. A two-dimensional array would permit a "real time" beam profile of an ultrasonic field to be characterized.

Additionally, the integration achieved by using semiconductor processing techniques to fabricate a support structure, interconnect schemes and desired electronic elements may be extended to the manufacture of other acoustic devices which employ membranes.

We claim:

1. A membrane hydrophone comprising:

a semiconductor substrate having an opening therethrough;

a patterned layer on said semiconductor substrate, said patterned layer forming a raised frame on said semiconductor substrate;

a flexible membrane of piezoelectric material, said membrane having a piezoelectrically active region and a piezoelectrically inactive region, said membrane having a bottom surface, said active region being formed within the perimeter of said inactive region, said active region having an area substantially less than the area of said inactive region, the periphery of said inactive region being attached to said frame on a side of said frame opposite to said semiconductor substrate, said bottom surface of said membrane thereby being supported above said semiconductor substrate in parallel relationship with said semiconductor substrate, said active region being aligned with said opening of said substrate such that said bottom surface is exposed therethrough; and electrode means on said membrane of piezoelectric material for conducting electrical charge from said active region.

2. The hydrophone of claim 1 wherein said semiconductor substrate includes electronic circuitry fabricated thereon.

3. The hydrophone of claim 1 wherein said patterned layer on said semiconductor substrate includes interconnect lines in electrical contact with said electrode means.

4. The hydrophone of claim 1 wherein said membrane of piezoelectric material is a polymeric membrane having a rigid patterned structure on said bottom surface, said rigid patterned structure having a configuration matching at least a portion of said frame, said rigid patterned structure being aligned with and attached to said frame.

5. The hydrophone of claim 1 further comprising a holder assembly, said semiconductor substrate being secured within said holder assembly.

6. The hydrophone of claim 1 wherein said membrane of piezoelectric material spans said frame, said membrane being mechanically and electrically bonded to said frame.

7. A membrane hydrophone for operation in a fluid environment comprising:

a substrate having an opening therethrough;

a mounting structure disposed upon a first surface of said substrate, said mounting structure having a perimeter enclosing said opening of said substrate, said mounting structure having a plurality of straight segments in end-to-end contact to define a configuration substantially aligned with said opening of said substrate; and a pliant piezoelectric membrane having a first surface and an opposed second surface, said membrane having a minor portion that is poled and a major portion that is unpoled, said poled portion being located within the interior region of said unpoled portion;

means for attaching said membrane to said mounting structure on a side of said mounting structure opposite to said substrate such that said first surface of said membrane is exposed to said fluid environment, said second surface of said membrane being parallel to said substrate and being exposed through said opening of said substrate, said poled portion being aligned with said opening of said substrate to expose said poled portion and a substantial region of said unpoled portion of said membrane to said fluid environment.

8. The membrane hydrophone of claim 7, wherein said substrate includes electronic circuitry fabricated thereon and said pliant piezoelectric membrane includes electrode means for electrically connecting said poled portion of said pliant piezoelectric membrane to said circuitry.

9. The membrane hydrophone of claim 8, wherein said pliant piezoelectric membrane is a polymeric material.

10. The membrane hydrophone of claim 8, wherein said mounting structure includes interconnect lines in electrical contact with said electrode means.

11. The membrane hydrophone of claim 7 wherein said pliant piezoelectric membrane spans said mounting structure, said membrane being mechanically and electrically bonded to said structure.

12. The membrane hydrophone of claim 7 wherein said pliant piezoelectric membrane includes a second mounting structure having a configuration to correspond with said mounting structure on said first surface of said substrate, said second mounting structure being between said pliant piezoelectric membrane and said substrate.

13. The membrane hydrophone of claim 12 wherein said means for attaching is a bonding material between said second mounting structure and said mounting structure on said first surface of said substrate.

* * * * *